US005638760A

United States Patent [19]

Jordan et al.

[11] Patent Number: 5,638,760

[45] **Date of Patent: *Jun. 17, 1997**

[54] LOAD DISTRIBUTOR FOR PALLETS

[75] Inventors: Richard Alan Jordan, Clinton Township; James William Jacoby, Jr., Rochester Hills; Raymond Harold Gosnell, Plymouth, all of Mich.

[73] Assignee: Cadillac Products, Inc., Sterling Heights, Mich.

[ * ] Notice: The term of this patent shall not extend beyond the expiration date of Pat. No. 5,549,056.

[21] Appl. No.: 673,073

[22] Filed: Jul. 1, 1996

Related U.S. Application Data

[63] Continuation of Ser. No. 220,965, Mar. 31, 1994, Pat. No. 5,549,056.

[51] Int. Cl.[6] ..... B65D 19/00

[52] U.S. Cl. ..... 108/51.1; 108/53.3

[58] Field of Search ..... 108/51.1, 53.1, 108/53.3, 53.5

[56] References Cited

U.S. PATENT DOCUMENTS

| | | | |
|---|---|---|---|
| Re. 32,344 | 2/1987 | Wind | 108/53.1 X |
| 3,187,691 | 6/1965 | Leitzel . | |
| 3,467,032 | 9/1969 | Rowlands et al. | 108/51.1 |
| 3,524,415 | 8/1970 | Heiman | 108/53.3 |
| 3,677,200 | 7/1972 | Cocagna et al. | 108/53.5 |
| 3,696,761 | 10/1972 | Brown | 108/53.3 |
| 3,699,901 | 10/1972 | Cook, III | 108/51.1 |
| 3,787,158 | 1/1974 | Brown et al. | 264/545 |
| 3,868,915 | 3/1975 | Hafner | 108/51.1 |
| 4,240,360 | 12/1980 | Sanders et al. | 108/53.3 |
| 4,413,737 | 11/1983 | Wind | 108/53.3 X |
| 4,428,306 | 1/1984 | Dresen et al. | 108/53.3 |
| 4,879,956 | 11/1989 | Shuert | 108/53.3 |
| 5,046,434 | 9/1991 | Breezer et al. | 108/51.1 |
| 5,197,396 | 3/1993 | Breezer et al. | 108/56.3 |

*Primary Examiner*—Peter M. Cuomo
*Assistant Examiner*—Robert J. Sandy
*Attorney, Agent, or Firm*—Brooks & Kushman P.C.

[57] ABSTRACT

An apparatus is disclosed for distributing a load applied thereto, such as by a shipping pallet. The apparatus comprises first and second thermoformed plastic sheets. The first sheet has a generally planar surface, a central indentation and a plurality of symmetrical peripheral indentations disposed around the central indentation, and a plurality of first ribs extending radially from the central indentation. The second sheet is joined with the first sheet and has a series of adjacent first channels which form a generally diamond-shaped patten. Each pair of adjacent first channels is separated by a raised portion including a groove and a pair of second ribs flanking the groove. Both the first channels and the grooves of the second sheet are recessed below a plane defined by the raised portions, the grooves being recessed to a depth less than the first channels. The first ribs are flanked by second channels recessed below the surface of the first sheet, and at least portions of the second channels are joined with the first channels of the second sheet.

20 Claims, 2 Drawing Sheets

LOAD DISTRIBUTOR FOR PALLETS

This is a continuation of application Ser. No. 08/220,965 filed on Mar. 31, 1994 now U.S. Pat. No. 5,549,056.

TECHNICAL FIELD

This invention relates to load distributors for pallets used in transporting and storing goods, and more particularly to a twin sheet thermoformed plastic load distributor.

BACKGROUND ART

Pallets for transporting and storing goods have been constructed of various materials including wood, steel and plastic. Plastic pallets in particular have gained increased acceptance due to factors such as their high strength-to weight ratio, resistance to corrosion, and durability. While numerous techniques for producing plastic pallets are known, it has become increasingly popular to thermoform plastic pallets, especially with a technique known as twin sheet thermoforming as discussed in U.S. Pat. No. 3,583,036, U.S. Pat. No. 3,787,158 and U.S. Pat. No. 3,925,140, all to Brown.

Twin sheet plastic pallets are designed to take maximum advantage of the materials used. Efforts have been made to maximize the load carrying capacity of the pallet for the given amount of material used in forming the pallet. U.S. Pat. No. 3,187,691 to Leitzel, for example, shows a pallet having linearly extending channels or ribs which are formed into the pallet to increase stiffness. These ribs or channels can have an undesirable effect of allowing bending or hinge moments to occur along the length of the rib, i.e. the material may flex about an axis determined by the length of the rib or channel.

Attempts to counteract this effect include U.S. Pat. No. 3,610,173 to McIlwraith, which shows a plastic pallet having thermoplastic top and bottom decks which are releasably assembled together in spaced apart relation by a plurality of spaced column members. Each of the decks has parallel linear channels in one surface, and a series of parallel channels running at an angle to the first series of channels in the opposite surface.

Structure such as the bottom deck shown in the McIlwraith '173 patent is advantageous to distribute over a wider area the focused pressure transfered by the legs of a loaded pallet, and thus minimize or eliminate unwanted damage when the pallets are stacked. U.S. Pat. No. 5,197,396 to Breezer et al., for example, also shows a double deck plastic pallet including a twin sheet thermoformed lower deck. The lower deck supports the pallet and its contents when the pallet is in storage either on a supporting surface or stacked on another loaded pallet.

SUMMARY OF THE INVENTION

The present invention is a load distributor for distributing a load applied thereto, and comprises first and second plastic sheets joined together. The first sheet has a generally planar surface, a central indentation and a plurality of peripheral indentations formed in the first sheet around the central indentation, and a plurality of first ribs extending radially from the central indentation. The second sheet has a series of adjacent channels, each pair of adjacent channels being separated by a raised portion which includes a groove and a pair of second ribs flanking the groove.

Accordingly, it is an object of the present invention to provide a load distributor of the type described above for distributing a load applied by a pallet used in transporting and storing goods.

Another object of the present invention is to provide a load distributor of the type described above which is manufactured by the twin sheet thermoforming process and resists deflecting in all directions.

These and other objects, features, and advantages of the present invention are readily apparent from the following detailed description of the best mode for carrying out the invention when taken in conjunction with the accompanying drawings.

BEST MODE FOR CARRYING OUT THE INVENTION

Figure 1:
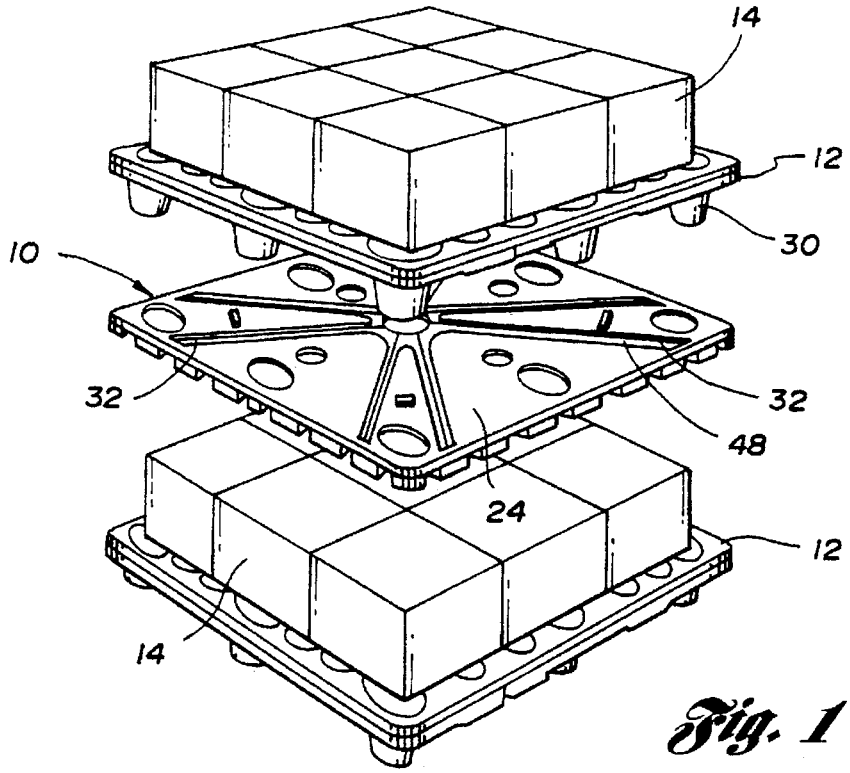
FIG. 1 is a perspective view of a load distributor according to the present invention stacked in between a pair of pallets bearing loads.
Figure 2:
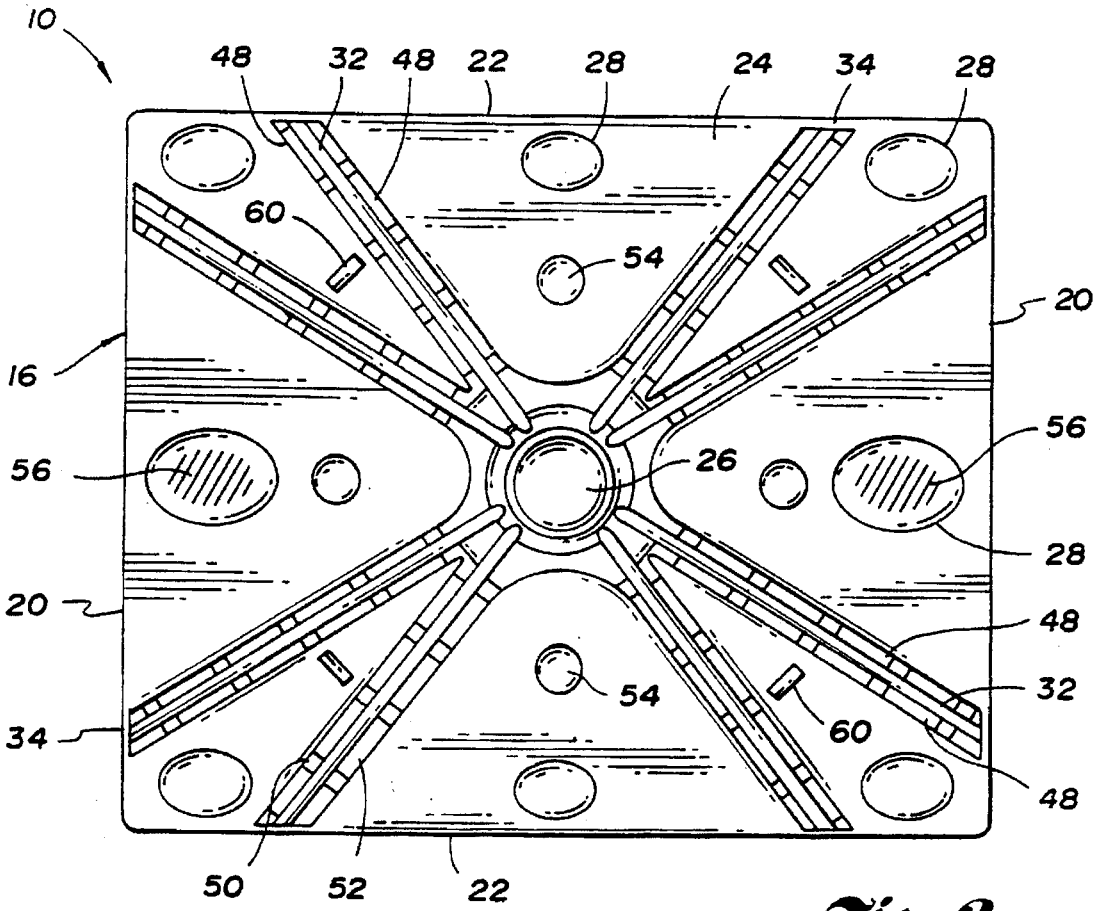
FIG. 2 is a top view of the load distributor.
Figure 3:
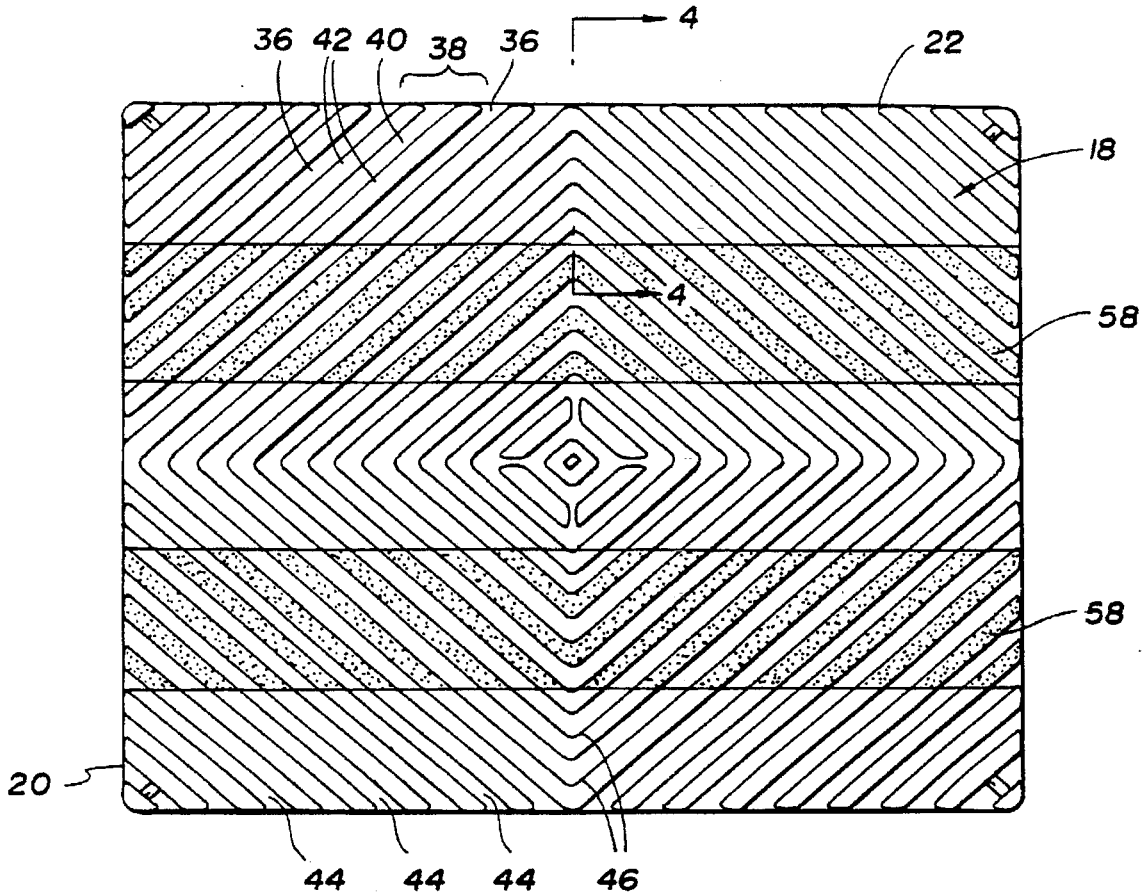
FIG. 3 is a bottom view of the load distributor.

With reference to the drawings, the preferred embodiments of the present invention will be described. FIGS. 1 through 3 show a load distributor 10 according to the present invention for evenly distributing a load applied thereto, such as by a pallet 12 supporting a collection of containers 14. The load distributor 10 is advantagously formed by a twin sheet thermoforming process and comprises a first sheet 16 and a second sheet 18. Preferably, both the first and second sheets 16 and 18 comprise a thermoplastic resin material such as high density polyethylene, vacuum formed and fused together by the thermoforming process to form a unitary plastic structure.

The sheets 16 and 18 are generally rectangular, with final dimensions approximately equivalent to the pallet with which the load distributor is to be paired. In a preferred embodiment shown in the figures, the shorter sides 20 are about forty inches long while the longer sides 22 are about forty-eight inches long and, when the sheets 16 and 18 are joined together, the load distributor 10 has a width of about two inches. The first sheet 16, which typically is the upper sheet when the load distributor 10 is in its normal orientation during usage as shown in FIG. 1, has a generally planar surface 24. A central indentation 26 is formed in the upper sheet 16, and a plurality of peripheral indentations 28 are formed in the upper sheet and disposed around the central indentation. Preferably, there are eight peripheral indentations 28 disposed symmetrically around the central indentation 26 to receive the similarly arranged legs 30 of the pallet 12, as described more fully below.

A plurality of first ribs 32 extend radially from the central indentation 26. The ribs 32 extend, preferably in a straight line, almost all the way out to the perimeter of the first sheet 16, but do not intersect the peripheral indentations 28. There are preferably eight ribs 32, each of which terminates at a flange 34 extending around the perimeter of the upper sheet 16. Of the eight ribs 32, two radiate outwardly to each of the longer and shorter sides 20 and 22, respectively, between the corners of the upper sheet 16.

Figure 4:
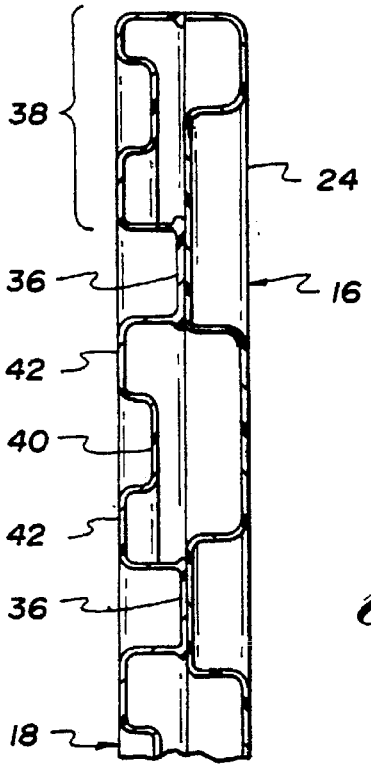
FIG. 4 is a cross-sectional view of the load distributor taken along line 4—4 in FIG. 3.

FIGS. 3 and 4 show the second or lower sheet 18, which has a series of substantially parallel adjacent first channels 36 formed in a generally diamond-shaped pattern. Each pair of adjacent channels 36 is separated by a raised portion 38 including a semi-depressed groove 40 and a pair of second ribs 42 flanking the groove. The channels 36 and the grooves 40 of the second sheet 18 are both recessed below a plane defined by the raised portions 38. The grooves 40, however, are shallower than the channels 36, i.e. they are recessed to a depth less than the depth of the channels.

In a preferred embodiment, an outermost series 44 of the channels 36 extend out to the perimeter of the lower sheet 18, unlike the ribs 32 on the upper sheet 16. These outermost channels 44 intersect the shorter side 20 6f the load distributor 10 at an angle between about forty and sixty degrees, preferably about fifty degrees, and intersect the longer side 22 at an angle between about thirty and fifty degrees, preferably about forty degrees. An innermost set 46 of the channels 36 by contrast, extend in a continous diamond shape without intersecting the perimeter of the lower sheet 18.

As best shown in FIGS. 1 and 2, the ribs 32 are recessed below the surface 24 of the upper sheet 16, and are flanked by second channels 48 recessed even further below the surface of the upper sheet. Along their radial extent, the channels 48 each have alternating sections 50 and 52 of relatively deep and shallow depression, respectively. At least the deep portions 50 of the channels 48 are joined at engineered fusion or knit points with portions of the shallow grooves 40 of the lower sheet 18 during the thermoforming process. Preferably, the shallower sections 52 of the channels 48 are also integrally fused or otherwise joined to portions of the channels 36 of the lower sheet.

The knitted structure established by the alternating heights of the joinder points between the upper and lower sheets 16 and 18 provides the load distributor 10 with increased strength and rigidity. In addition to the knitting, the upper and lower sheets are joined around their edges and at the indentations 26 and 28. Also, a series of four inner detents 54 are preferably formed in the upper sheet 16 to provide additional fusion points for the lower sheet 18 to increase rigidity of the load distributor 10 and inhibit warpage. Furthermore, because the ribs 32 radiate from the center of the upper sheet 16, each rib intersects the generally parallel bottom channels 36 at the same angle as the distance from the center of the sheet increases, but intersect any particular channel 36 at a different angle than does the nearest neighboring rib 32.

The central indentation 26 and the peripheral indentations 28 are adapted to accept some or all of the legs 30 depending from the pallet 12. All of the indentations 26 and 28 are preferably oval shaped to accomodate the pallet having a central leg and eight outboard legs described in U.S. Ser. No. 07/975,805, assigned to the assignee of the present invention and hereby incorporated by reference. To facilitate the removable joinder of the pallet 12 and the load distributor 10, mechanical attachment means such as hook and loop type fastener patches 56 may be provided in the bottoms of some or all of the peripheral indentations 28 to mate with corresponding fasteners disposed on the bottom of the pallet legs 30. The largest of the peripheral indentations 28 are situated generally near the middle of each of the short sides 20 of the upper sheet 16. The medium sized indentations 28 are located near the corners of the upper sheet 16, while the smallest peripheral indentations are provided adjacent the longer sides 22.

When the pallet 12 is received in the load distributor 10, the localized loads which would otherwise be transferred through the legs of the pallet are distributed, preferably uniformly, over the greater area of the ribs 42 of the lower sheet 18. To inhibit slippage of the load distributor 10 over whatever surface it is resting on, non-skid means are preferrably positioned at strategic areas of the surface of the bottom sheet 18. In a preferred embodiment, a relatively soft non-skid thermoplastic material such as Santoprene (TM, Monsanto Corp.) is coextruded with or laminated to the bottom sheet prior to the twin sheet thermoforming operation so as to be integral therewith. Ideally, after the twin sheet thermoforming operation, two parallel strips 58 of the non-skid material preferably lie lengthwise along the bottom sheet 18, each about eight inches wide with their closest edge about five inches on either side of the centerline of the bottom sheet. Alternatively, of course, non-skid pads may be added on to the second sheet 18 at one or more spots after the twin sheeting operation.

The top sheet 16 may also be provided with either integral or seperable non-skid means to inhibit slippage between load distributors when they are stacked during non-use or storage. Similarly, stacking lugs 60 may be molded into, screwed onto, or otherwise connected to the upper sheet 16 to grab into the channels 36 on the lower sheet 18 when multiple load distributors are stacked upon each other so that no relative slippage occurs when the load distributors are not in use.

It should be understood that while the forms of the invention herein shown and described constitute preferred embodiments of the invention, they are not intended to illustrate all possible forms thereof. It should also be understood that the words used are words of description rather than limitation, and various changes may be made without departing from the spirit and scope of the invention disclosed.

We claim:

1. A load distributor for distributing a load applied thereto by a pallet, the load distributor comprising:

a first sheet having a generally planar surface, a central indentation formed in the first sheet, a plurality of peripheral indentations formed in the first sheet and disposed around the central indentation, and a rib; and a second sheet having a generally planar surface and a plurality of first depressions extending to a first depth and a plurality of second depressions extending to a second depth less than the first depth;

at least one of the first depressions being joined to the rib of the first sheet, and at least one of the second depressions being joined to the central indentation.

2. The load distributor of claim 1 wherein the first and second sheets are generally rectangular.

3. The load distributor of claim 1 wherein the first and second sheets comprise a thermoplastic material.

4. The load distributor of claim 3 wherein the thermoplastic material comprises high density polyethylene.

5. The load distributor of claim 1 wherein the rib is recessed below the surface of the first sheet.

6. The load distributor of claim 1 wherein the rib does not intersect the peripheral indentations.

7. The load distributor of claim 1 wherein the peripheral indentations formed in the first sheet comprise eight indentations disposed symmetrically around the central indentation.

8. The load distributor of claim 1 wherein the rib does not extend entirely out to the perimeter of the first sheet.

9. The load distributor of claim 1 wherein the peripheral indentations are adapted to accept legs depending from the pallet.

10. The load distributor of claim 1 wherein at least one of the peripheral indentations includes hook and loop type fasteners.

11. The load distributor of claim 1 wherein the first sheet further comprises stacking lugs.

12. The load distributor of claim 1 wherein the first sheet further comprises first non-skid means for inhibiting slippage between the first sheet and an abutting structure.

13. The load distributor of claim 12 wherein the first non-skid means are coextruded with the first sheet.

14. The load distributor of claim 12 wherein the first non-skid means are laminated on to the first sheet.

15. The load distributor of claim 1 wherein the second sheet further comprises second non-skid means for inhibiting slippage between the second sheet and an abutting structure.

16. The load distributor of claim 14 wherein the second non-skid means are coextruded with the second sheet.

17. The load distributor of claim 14 wherein the second non-skid means are laminated on to the second sheet.

18. The load distributor of claim 14 wherein the second non-skid means cover only a portion of the second sheet.

19. A load distributor for distributing a load applied thereto by a pallet, the load distributor comprising:

a first sheet having a generally planar surface, a central indentation formed in the first sheet, a plurality of peripheral indentations formed in the first sheet and disposed around the central indentation, and a rib; and a second sheet having a generally planar surface and a plurality of first areas extending to a first depth and a plurality of second areas extending to a second depth less than the first depth;

at least one of the first areas being joined to the rib of the first sheet, and at least one of the second areas being joined to the central indentation.

20. A load distributor for distributing a load applied thereto by a pallet, the load distributor comprising:

a first sheet having a generally planar surface, a central indentation formed in the first sheet, a plurality of peripheral indentations formed in the first sheet and disposed around the central indentation, and a rib; and a second sheet having a generally planar surface and a plurality of first recesses extending to a first depth and a plurality of second recesses extending to a second depth less than the first depth;

at least one of the first recesses being joined to the rib of the first sheet, and at least one of the second recesses being joined to the central indentation.

* * * * *

UNITED STATES PATENT AND TRADEMARK OFFICE

CERTIFICATE OF CORRECTION

PATENT NO. : 5,638,760

DATED : June 17, 1997

INVENTOR(S) : RICHARD ALAN JORDAN, et al.

It is certified that error appears in the above-identified patent and that said Letters Patent is hereby corrected as shown below:

| | |
|---|---|
| Column 5, Line 14, | Delete "14" and insert "15". |
| Column 5, Line 16, | Delete "14" and insert "15". |
| Column 5, Line 18, | Delete "14" and insert "15". |

Signed and Sealed this

Fourteenth Day of July, 1998

Bruce Lehman

*Attest:*

BRUCE LEHMAN

*Attesting Officer*

*Commissioner of Patents and Trademarks*